US010218126B2

(12) United States Patent
Kurosawa

(10) Patent No.: US 10,218,126 B2
(45) Date of Patent: Feb. 26, 2019

(54) CONNECTOR AND CONNECTOR ASSEMBLY

(71) Applicant: JAPAN AVIATION ELECTRONICS INDUSTRY, LIMITED, Shibuya-ku, Tokyo (JP)

(72) Inventor: Tomoya Kurosawa, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/766,917

(22) PCT Filed: Oct. 13, 2016

(86) PCT No.: PCT/JP2016/080349
§ 371 (c)(1),
(2) Date: Apr. 9, 2018

(87) PCT Pub. No.: WO2017/081978
PCT Pub. Date: May 18, 2017

(65) Prior Publication Data

US 2018/0309243 A1 Oct. 25, 2018

(30) Foreign Application Priority Data

Nov. 9, 2015 (JP) ..... 2015-219671

(51) Int. Cl.
*H01R 13/658* (2011.01)
*H01R 13/6581* (2011.01)
(Continued)

(52) U.S. Cl.
CPC ..... *H01R 13/6581* (2013.01); *H01R 13/405* (2013.01); *H01R 13/502* (2013.01); *H01R 24/60* (2013.01); *H01R 2107/00* (2013.01)

(58) Field of Classification Search
CPC ..... H01R 13/6581
See application file for complete search history.

(56) References Cited

U.S. PATENT DOCUMENTS 9,276,365 B2 * 3/2016 Yu ..... H01R 13/6594
9,306,337 B2 * 4/2016 Yu ..... H01R 24/60
(Continued)

FOREIGN PATENT DOCUMENTS

CN 103956617 A 7/2014
CN 203859265 U 10/2014
(Continued)

OTHER PUBLICATIONS

International Search Report (ISR) dated Dec. 20, 2016 issued in International Application No. PCT/JP2016/080349.
(Continued)

*Primary Examiner* — Ross N Gushi
(74) *Attorney, Agent, or Firm* — Holtz, Holtz & Volek PC

(57) ABSTRACT

A connector is mountable on a circuit board and mateable with a mating connector along a front-rear direction. The connector comprises a ground member, a holding member, a plurality of contacts and a midplate. The ground member has an upper plate portion, a lower plate portion, a coupling portion, a fixed leg and an extending portion. Each of the upper plate portion and the lower plate portion extends in a predetermined plane intersecting with an up-down direction. The fixed leg is configured to be fixed to the circuit board. The fixed leg extends downward in the up-down direction from the extending portion. The extending portion connects the fixed leg and the lower plate portion with each other. The extending portion extends in the predetermined plane from the lower plate portion. The plurality of contacts are arranged in two contact rows.

11 Claims, 10 Drawing Sheets

(51) Int. Cl.

| | |
|---|---|
| ***H01R 24/60*** | (2011.01) |
| ***H01R 13/405*** | (2006.01) |
| ***H01R 13/502*** | (2006.01) |
| *H01R 107/00* | (2006.01) |

(56) References Cited

U.S. PATENT DOCUMENTS

| | | | | |
|---|---|---|---|---|
| 9,350,121 | B2 * | 5/2016 | Ju | H01R 13/6585 |
| 9,356,406 | B2 * | 5/2016 | Yen | H01R 13/6581 |
| 9,425,558 | B1 * | 8/2016 | Hsu | H01R 12/724 |
| 9,425,559 | B2 * | 8/2016 | Kao | H01R 13/6585 |
| 9,425,560 | B1 * | 8/2016 | Su | H01R 13/6591 |
| 9,461,415 | B2 * | 10/2016 | Guo | H01R 13/41 |
| 9,478,915 | B2 * | 10/2016 | Guo | H01R 13/6585 |
| 9,484,662 | B2 * | 11/2016 | Guo | H01R 13/504 |
| 9,484,677 | B2 * | 11/2016 | Guo | H01R 13/6585 |
| 9,484,679 | B2 * | 11/2016 | Guo | H01R 13/6585 |
| 9,490,580 | B2 * | 11/2016 | Lan | H01R 13/646 |
| 9,490,594 | B2 * | 11/2016 | Little | H01R 24/60 |
| 9,490,595 | B2 * | 11/2016 | Little | H01R 13/6594 |
| 9,496,664 | B2 * | 11/2016 | Little | H01R 13/6587 |
| 9,502,839 | B2 * | 11/2016 | Little | H01R 12/724 |
| 9,509,084 | B2 * | 11/2016 | Zhao | H01R 13/5202 |
| 9,525,243 | B1 * | 12/2016 | Yuan | H01R 13/6585 |
| 9,525,244 | B1 * | 12/2016 | Hsu | H01R 13/6585 |
| 9,525,251 | B2 * | 12/2016 | Yen | H01R 24/60 |
| 9,548,571 | B2 * | 1/2017 | Deng | H01R 13/6581 |
| 9,577,387 | B2 * | 2/2017 | Hu | H01R 13/6597 |
| 9,590,336 | B2 * | 3/2017 | Tsai | H01R 12/75 |
| 9,614,333 | B2 * | 4/2017 | Tsai | H01R 24/70 |
| 9,627,817 | B2 * | 4/2017 | Chang | H01R 13/6594 |
| 9,640,923 | B2 * | 5/2017 | Kao | H01R 12/724 |
| 9,647,393 | B2 * | 5/2017 | Tsai | H01R 13/6581 |
| 9,653,850 | B1 * | 5/2017 | Su | H01R 13/6585 |
| 9,653,851 | B1 * | 5/2017 | Yuan | H01R 13/6594 |
| 9,660,399 | B2 * | 5/2017 | Hsu | H01R 24/60 |
| 9,673,552 | B2 * | 6/2017 | Tsai | H01R 24/60 |
| 9,673,569 | B2 * | 6/2017 | Zhang | H01R 13/6585 |
| 9,680,254 | B1 * | 6/2017 | Nishikata | H01R 13/627 |
| 9,705,217 | B2 * | 7/2017 | Ju | H01R 24/78 |
| 9,728,899 | B2 * | 8/2017 | Peng | H01R 13/6581 |
| 9,742,095 | B2 * | 8/2017 | Tsai | H01R 13/502 |
| 9,748,701 | B2 * | 8/2017 | Tsai | H01R 24/62 |
| 9,831,615 | B2 * | 11/2017 | Saito | H01R 13/6581 |
| 9,837,772 | B2 * | 12/2017 | Tsai | H01R 13/502 |
| 9,843,141 | B2 * | 12/2017 | Peng | H01R 13/6581 |
| 9,905,944 | B2 * | 2/2018 | Little | H01R 13/6658 |
| 9,917,405 | B2 * | 3/2018 | Ju | H01R 13/6585 |
| 9,923,317 | B2 * | 3/2018 | Yao | H01R 24/62 |
| 9,935,401 | B2 * | 4/2018 | Tsai | H01R 13/652 |
| 9,960,522 | B2 * | 5/2018 | Tada | H01R 12/707 |
| 9,960,544 | B2 * | 5/2018 | Ho | H01R 13/6595 |
| 9,972,946 | B2 * | 5/2018 | Ju | H01R 13/6585 |
| 9,991,640 | B2 * | 6/2018 | Tziviskos | H01R 13/6581 |
| 9,997,853 | B2 * | 6/2018 | Little | H01R 13/6471 |
| 9,997,866 | B1 * | 6/2018 | Hsu | H01R 13/5202 |
| 10,008,811 | B2 * | 6/2018 | Ho | H01R 13/6585 |
| 10,020,619 | B2 * | 7/2018 | Zhang | H01R 12/7082 |
| 10,038,260 | B2 * | 7/2018 | Ju | H01R 24/78 |
| 10,044,130 | B2 * | 8/2018 | Zhang | H01R 12/7082 |
| 2015/0364888 | A1 * | 12/2015 | Yu | H01R 13/6585 264/250 |
| 2016/0036175 | A1 | 2/2016 | Yen et al. | |
| 2016/0049756 | A1 | 2/2016 | Yen et al. | |
| 2016/0064869 | A1 * | 3/2016 | Yu | H01R 24/60 439/607.05 |
| 2016/0134059 | A1 | 5/2016 | Deng | |
| 2016/0233631 | A1 * | 8/2016 | Yen | H01R 13/6585 |
| 2016/0276782 | A1 * | 9/2016 | Chang | H01R 13/6585 |
| 2016/0380389 | A1 * | 12/2016 | Ju | H01R 13/6585 439/607.05 |
| 2017/0040724 | A1 * | 2/2017 | Little | H01R 12/724 |
| 2017/0214193 | A1 * | 7/2017 | Tsai | H01R 13/502 |
| 2017/0222342 | A1 * | 8/2017 | Ho | H01R 12/71 |
| 2017/0237195 | A1 * | 8/2017 | Oguro | H01R 13/502 439/607.01 |
| 2017/0279234 | A1 * | 9/2017 | Tsai | H01R 13/6585 |
| 2017/0302035 | A1 * | 10/2017 | Ju | H01R 13/6585 |
| 2017/0310056 | A1 * | 10/2017 | Yuan | H01R 12/71 |
| 2017/0310057 | A1 * | 10/2017 | Ju | H01R 13/6585 |
| 2017/0310058 | A1 * | 10/2017 | Ju | H01R 13/6585 |
| 2017/0324175 | A1 * | 11/2017 | Ju | H01R 24/78 |
| 2017/0331229 | A1 * | 11/2017 | Cheng | H01R 24/62 |
| 2017/0338576 | A1 * | 11/2017 | Sato | H01R 4/184 |
| 2017/0346206 | A1 * | 11/2017 | Ju | H01R 24/78 |
| 2017/0346237 | A1 * | 11/2017 | Ju | H01R 13/6585 |
| 2017/0346239 | A1 * | 11/2017 | Ju | H01R 13/6585 |
| 2018/0019551 | A1 * | 1/2018 | Ju | H01R 13/6585 |
| 2018/0090892 | A1 * | 3/2018 | Little | H01R 24/60 |
| 2018/0097313 | A1 * | 4/2018 | Ju | H01R 13/04 |
| 2018/0109042 | A1 * | 4/2018 | Little | H01R 13/405 |
| 2018/0138642 | A1 * | 5/2018 | Kong | H01R 13/6594 |
| 2018/0145462 | A1 * | 5/2018 | Feng | H01R 13/6596 |
| 2018/0166830 | A1 * | 6/2018 | Feng | H01R 13/6593 |
| 2018/0175555 | A1 * | 6/2018 | Zhao | H01R 13/6471 |
| 2018/0175568 | A1 * | 6/2018 | McCracken | H01R 24/64 |
| 2018/0191102 | A1 * | 7/2018 | Arai | H01R 13/6585 |
| 2018/0287288 | A1 * | 10/2018 | Shah | H01R 13/465 |

FOREIGN PATENT DOCUMENTS

| | | | |
|---|---|---|---|
| CN | 204103126 | U | 1/2015 |
| CN | 204103158 | U | 1/2015 |
| CN | 204289804 | U | 4/2015 |
| CN | 204481257 | U | 7/2015 |
| JP | 2005123163 | A | 5/2005 |
| JP | 2009295385 | A | 12/2009 |
| JP | 3198686 | U | 7/2015 |
| JP | 3200315 | U | 10/2015 |
| TW | 511687 | U | 11/2015 |

OTHER PUBLICATIONS

Japanese Office Action dated Aug. 2, 2017 issued in Japanese Application No. 2015-219671.

Taiwanese Office Action dated Jun. 20, 2017 issued in counterpart Taiwanese Application No. 105134252.

Written Opinion dated Dec. 20, 2016 issued in International Application No. PCT/JP2016/080349.

* cited by examiner

【図 14】

【図 16】

CONNECTOR AND CONNECTOR ASSEMBLY

TECHNICAL FIELD

This invention relates to a connector which is mountable on a circuit board and which is mateable with a mating connector, and to a connector assembly.

BACKGROUND ART

Referring to FIGS. 19 to 20, Patent Document 1 discloses a connector socket 900 which is mateable with a connector plug (not shown). The connector socket 900 of Patent Document 1 comprises a housing 910, an insulating main body 920, two cover plates (ground members) 930, terminal supporting pieces 942, terminals 941 and a separation plate 950. The two cover plates 930 are arranged in opposite sides, respectively, of the insulating main body 920 in an up-down direction. Each of the terminal supporting pieces 942 is inserted into the insulating main body 920. The terminals 941 are supported by the terminal supporting piece 942. The cover plates 930 are integrally formed with positional lugs 931 and locking lugs 932. The insulating main body 920 is provided with positional lug inserting ditches 921 and locking lug inserting ditches 922. The positional lug inserting ditches 921 correspond to the positional lugs 931, respectively. The locking lug inserting ditches 922 correspond to the locking lugs 932, respectively. The cover plate 930, which is positioned upward of the insulating main body 920, is press-fit downwardly into the insulating main body 920. The cover plate 930, which is positioned downward of the insulating main body 920, is press-fit upwardly into the insulating main body 920. Meanwhile, each of the positional lugs 931 is inserted into the positional lug inserting ditch 921 corresponding thereto, while each of the locking lugs 932 is inserted into the locking lug inserting ditch 922 corresponding thereto. Each of the cover plates 930 is configured to be connected with a plug housing (not shown) of the connector plug (not shown) when the connector socket 900 and the connector plug (not shown) are mated with each other.

PRIOR ART DOCUMENTS

Patent Document(s)

Patent Document 1: JPU 3198686

SUMMARY OF INVENTION

Technical Problem

Generally, in a case where a ground member and a circuit board are connected with each other through a shell or the like, a connector may have variations in electrical characteristic depending on reliability of connection of the ground member with the shell or the like and on reliability of connection of the shell or the like with the circuit board.

It is therefore an object of the present invention to provide a connector which can have a stable electrical characteristic and which has a reduced height.

Solution to Problem

An aspect of the present invention provides a connector mountable on a circuit board and mateable with a mating connector along a front-rear direction. The mating connector comprises a plurality of mating contacts. The connector comprises a ground member, a holding member, a plurality of contacts and a midplate. The ground member has an upper plate portion, a lower plate portion, a coupling portion, a fixed leg and an extending portion. The upper plate portion and the lower plate portion are arranged so as to be apart from each other in an up-down direction perpendicular to the front-rear direction. Each of the upper plate portion and the lower plate portion extends in a predetermined plane intersecting with the up-down direction. The coupling portion couples the upper plate portion and the lower plate portion with each other. The fixed leg is configured to be fixed to the circuit board. The fixed leg extends downward in the up-down direction from the extending portion. The extending portion connects the fixed leg and the lower plate portion with each other. The extending portion extends in the predetermined plane from the lower plate portion. The holding member has a holding portion and a fitting portion. The holding portion is sandwiched by the upper plate portion and the lower plate portion in the up-down direction. The fitting portion extends forward in the front-rear direction from the holding portion. The fitting portion is positioned forward in the front-rear direction beyond any of the upper plate portion and the lower plate portion. The fitting portion has an upper surface and a lower surface each facing in the up-down direction. The plurality of contacts are arranged in two contact rows. The contacts of each of the contact rows are arranged in a pitch direction perpendicular to the front-rear direction and the up-down direction. Each of the contacts has a held portion and a contact portion. The held portion is held by the holding portion. The contact portions are configured to be brought into contact with the mating contacts, respectively, of the mating connector when the connector is mated with the mating connector. The contact portion is exposed outside the fitting portion on the upper surface or the lower surface of the fitting portion. The midplate is held by the holding member so as to be positioned between the contact rows in the up-down direction.

Another aspect of the present invention provides a connector assembly comprising the connector and the circuit board. The circuit board is formed with a single through hole. The midplate has a leg portion. The leg portion and the fixed leg are fixed to the single through hole.

Advantageous Effects of Invention

In the connector of the present invention, the ground member can be directly connected to a circuit board. Accordingly, as compared with a connector having a structure in which a ground member and a circuit board are connected with each other through a shell or the like, the connector of the present invention can be prevented from having variations in electrical characteristic even if the connector has variations in quality resulting from a connecting process of an assembly of the connector.

Furthermore, in the connector of the present invention, the extending portion extends in a plane same as a plane in which the lower plate portion extends, and the fixed leg extends from the extending portion. Accordingly, the fixed leg can have an increased length. In other words, the fixed leg can have an increased dimension in the up-down direction. Thus, when the fixed leg is soldered to a circuit board in a case where the connector of the present invention is fixed on the circuit board, there is a reduced possibility that the contacts are short-circuited with each other by solder which flows up the fixed leg.

An appreciation of the objectives of the present invention and a more complete understanding of its structure may be had by studying the following description of the preferred embodiment and by referring to the accompanying drawings.

DESCRIPTION OF EMBODIMENTS

Figure 1:
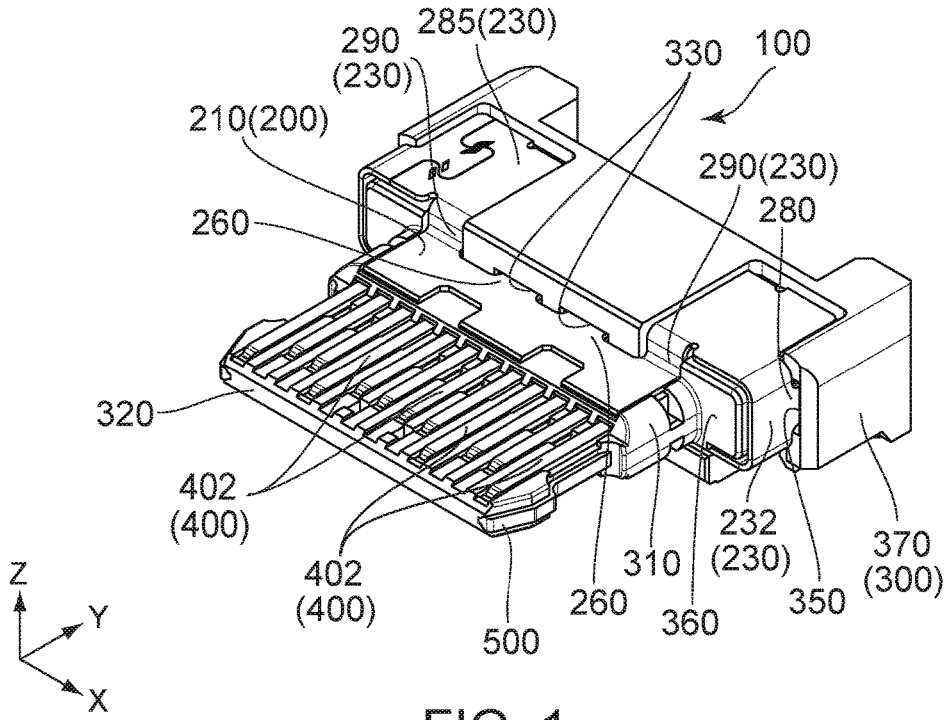
FIG. 1 is an upper perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

As shown in FIGS. 1 to 5 and 12, a connector 100 according to an embodiment of the present invention is mountable on a circuit board 700 and mateable with a mating connector (not shown) along a front-rear direction. The mating connector has a plurality of mating contacts (not shown). In the present embodiment, the front-rear direction is a Y-direction. It is assumed that forward is a negative Y-direction while rearward is a positive Y-direction.

As shown in FIGS. 1 to 4, the connector 100 of the present embodiment comprises a ground member 200, a holding member 300, a plurality of first contacts (contacts) 400, a plurality of second contacts (contacts) 450, a midplate 500 and an auxiliary holding member 380. The ground member 200 is made of metal. The holding member 300 is made of insulator. Each of the first contacts 400 is made of metal. Each of the second contacts 450 is made of metal. The midplate 500 is made of metal. Since the connector 100 of the present embodiment has no shell, the connector 100 has a reduced height and is easy to be assembled as compared with a connector having a shell.

As shown in FIGS. 1 to 4 and 11, the holding member 300 has a holding portion 310, a fitting portion 320, a middle portion 360, a supporting portion 370 and two projecting portions 372. The holding portion 310 connects the fitting portion 320 and the middle portion 360 with each other in the front-rear direction. The fitting portion 320 has a plate-like portion. The fitting portion 320 extends forward in the front-rear direction from the holding portion 310. The middle portion 360 is positioned rearward of the holding portion 310. The middle portion 360 connects the holding portion 310 and the supporting portion 370 with each other in the front-rear direction. The supporting portion 370 is positioned rearward of the middle portion 360. The projecting portions 372 are positioned in the vicinities of opposite ends, respectively, of the supporting portion 370 in a pitch direction perpendicular to the front-rear direction. In the present embodiment, the pitch direction is an X-direction. Each of the projecting portions 372 is positioned at a lower end of the supporting portion 370 in an up-down direction perpendicular to both the front-rear direction and the pitch direction. Each of the projecting portions 372 protrudes downward. In the present embodiment, the up-down direction is a Z-direction. Upward is a positive Z-direction, while downward is a negative Z-direction.

As shown in FIGS. 1 to 4 and 11, the holding member 300 is formed with two upper press-fit ditches 330, two lower press-fit ditches 340, two auxiliary press-fit ditches 350, two outer portion accommodating portions 374 and a plurality of contact holding ditches 322. Each of the upper press-fit ditches 330 is positioned at an upper side of the holding portion 310. Each of the upper press-fit ditches 330 is recessed rearward. Each of the upper press-fit ditches 330 has inner walls, which face each other in the pitch direction, and inner walls which face each other in the up-down direction. Each of the lower press-fit ditches 340 is positioned at a lower side of the holding portion 310. Each of the lower press-fit ditches 340 is recessed rearward. Each of the lower press-fit ditches 340 has inner walls, which face each other in the pitch direction, and inner walls which face each other in the up-down direction. The auxiliary press-fit ditches 350 are positioned in the vicinities of opposite side surfaces, respectively, of the supporting portion 370 in the pitch direction. Each of the auxiliary press-fit ditches 350 is recessed rearward. Each of the auxiliary press-fit ditches 350 has inner walls, which face each other in the pitch direction, and inner walls which face each other in the up-down direction. Each of the outer portion accommodating portions 374 is a part of upper surfaces of the middle portion 360 and the supporting portion 370. The outer portion accommodating portions 374 are positioned in the vicinities of opposite ends, respectively, of the upper surfaces of the middle portion 360 and the supporting portion 370 in the pitch direction. Each of the contact holding ditches 322 is a ditch extending in the front-rear direction. The contact holding ditches 322 are formed on each of an upper surface and a lower surface of the fitting portion 320.

As shown in FIGS. 1 to 4 and 11, the plurality of first contacts (contacts) 400 form a first contact row (contact row), while the plurality of second contacts (contacts) 450 form a second contact row (contact row). The first contact row is positioned above the second contact row in the up-down direction. The first contacts 400, which form the first contact row, are arranged in the pitch direction. The second contacts 450, which form the second contact row, are arranged in the pitch direction.

Figure 6:
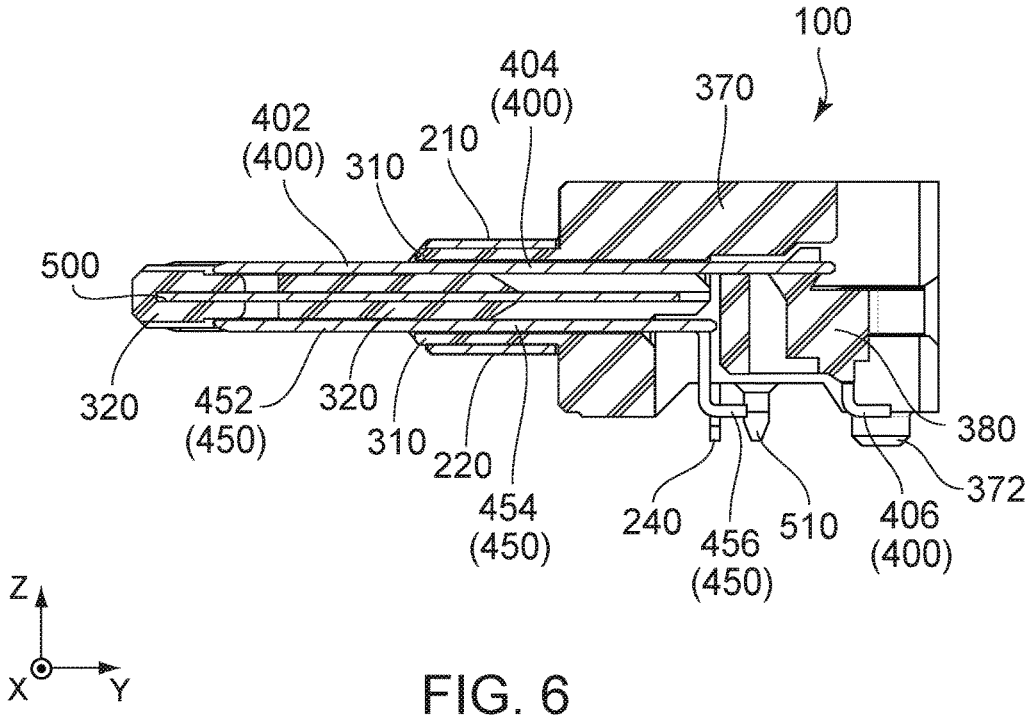
FIG. 6 is a cross-sectional view showing the connector of FIG. 5, taken along line A-A.
Figure 7:
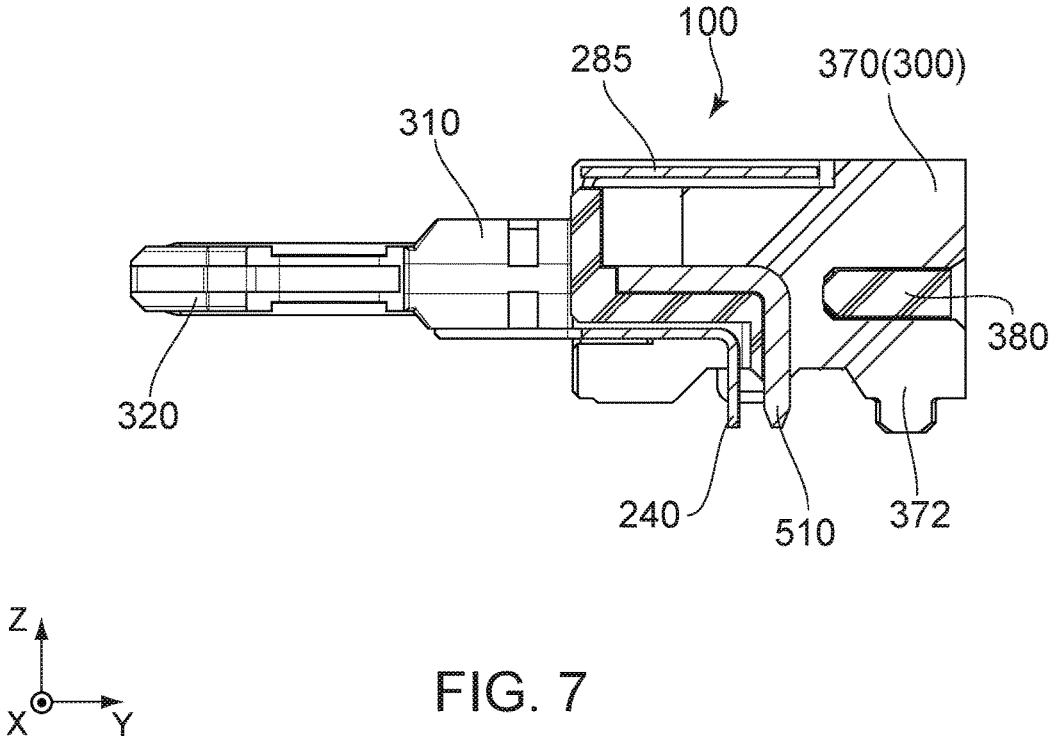
FIG. 7 is a cross-sectional view showing the connector of FIG. 5, taken along lone B-B.
Figure 11:
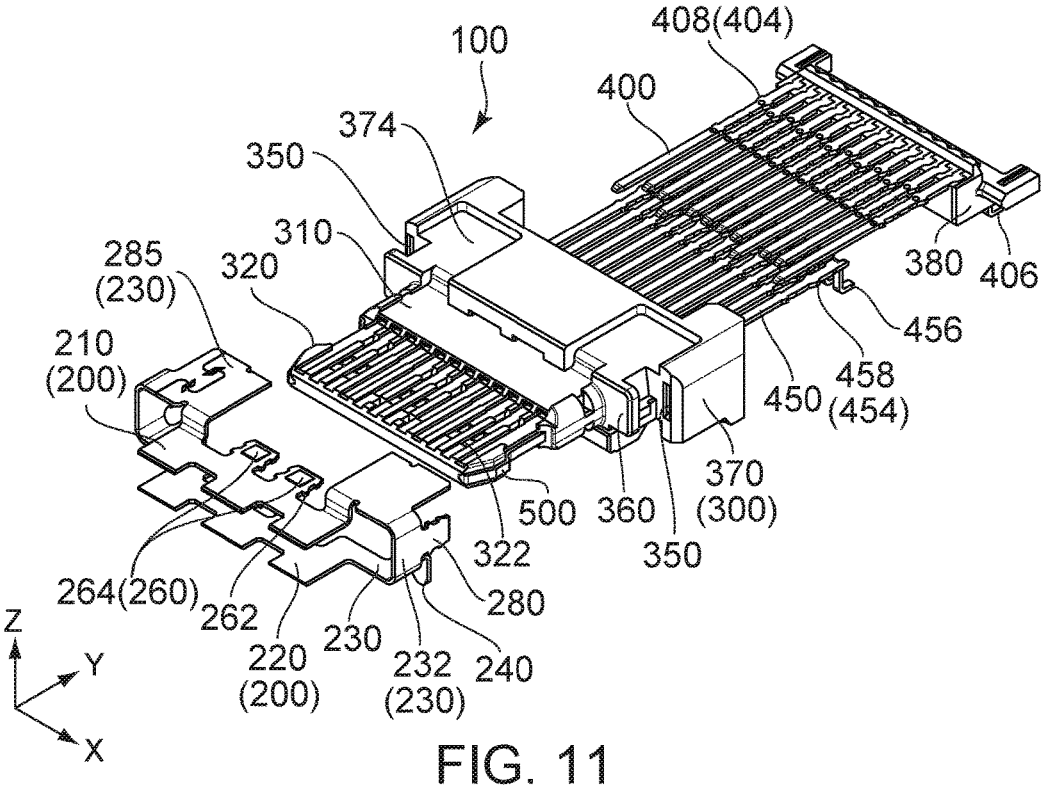
FIG. 11 is an exploded, perspective view showing the connector of FIG. 1.

As understood from FIGS. 6 and 11, each of the first contacts 400 has a first held portion 404 (held portion), a first contact portion 402 (contact portion) and a first fixed portion 406. The first held portion 404 (held portion) is held by the holding portion 310. The first contact portion 402 (contact portion) is exposed outside the fitting portion 320 on the upper surface of the fitting portion 320. The first fixed portion 406 is configured to be soldered on the circuit board 700. The first held portion 404 extends forward from an upper end of the first fixed portion 406. The first held portion 404 has first contact press-fit portions 408 which are positioned at its opposite ends, respectively, in the pitch direction. Each of the first contact press-fit portions 408 protrudes outward in the pitch direction. The first contact portion 402 extends forward from a front end of the first held portion 404. The first contact portions 402 are held by the contact holding ditches 322, respectively, which are formed on the upper surface of the fitting portion 320 of the holding member 300. The first contact portions 402 of the first contacts 400 are configured to be brought into contact with the mating contacts (not shown) of the mating connector (not shown) under a state where the connector 100 is mated with the mating connector (not shown). The first fixed portion 406 has an L-like shape. The first fixed portion 406 extends downward from a rear end of the first held portion 404 and then extends rearward. As understood from FIGS. 6 and 11, the auxiliary holding member 380 holds the vicinity of a rear end of the first held portion 404 and a part of the first fixed portion 406 of the first contact 400, wherein the part of the first fixed portion 406 extends upward.

As understood from FIGS. 1 and 11, each of the first contacts 400 is attached to the holding member 300 by being press-fit into the holding member 300. Specifically, first, each of the first contacts 400 is attached to the auxiliary holding member 380. Next, a front end of the first contact portion 402 of each of the first contacts 400, which are attached to the auxiliary holding member 380, is pushed forward from a rear end of the holding member 300, so that the first contact press-fit portions 408 of each of the first contacts 400 bite into the holding member 300. Accordingly, each of the first contacts 400 is held by the holding member 300.

As understood from FIGS. 6 and 11, each of the second contacts 450 has a second held portion 454 (held portion), a second contact portion 452 (contact portion) and a second fixed portion 456. The second held portion 454 (held portion) is held by the holding portion 310. The second contact portion 452 (contact portion) is exposed outside the fitting portion 320 on the lower surface of the fitting portion 320. The second fixed portion 456 is configured to be soldered on the circuit board 700. The second held portion 454 extends forward from an upper end of the second fixed portion 456. The second held portion 454 has second contact press-fit portions 458 which are positioned at its opposite ends, respectively, in the pitch direction. Each of the second contact press-fit portions 458 protrudes outward in the pitch direction. The second contact portion 452 extends forward from a front end of the second held portion 454. The second contact portions 452 are held by the contact holding ditches 322, respectively, which are formed on the lower surface of the fitting portion 320 of the holding member 300. The second contact portions 452 of the second contacts 450 are configured to be brought into contact with the mating contacts (not shown) of the mating connector (not shown) under the state where the connector 100 is mated with the mating connector (not shown). The second fixed portion 456 has an L-like shape. The second fixed portion 456 extends downward from a rear end of the second held portion 454 and then extends rearward.

Figure 2:
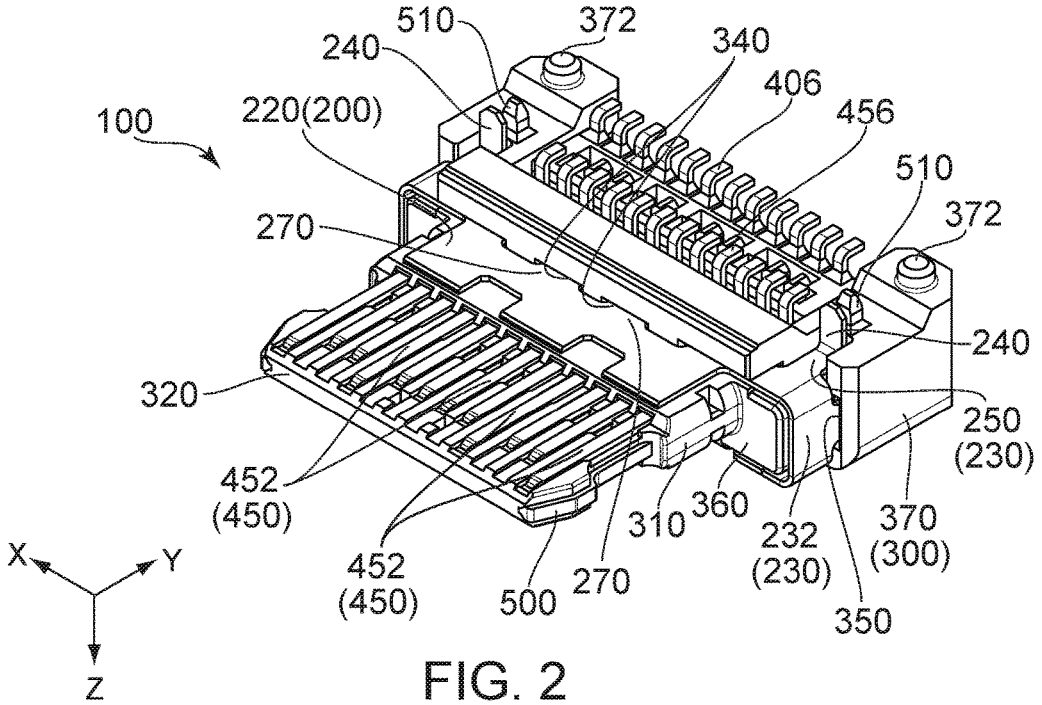
FIG. 2 is a lower perspective view showing the connector of FIG. 1.

As understood from FIGS. 2 and 11, each of the second contacts 450 is attached to the holding member 300 by being press-fit into the holding member 300. Specifically, a front end of the second contact portion 452 of each of the second contacts 450 is pushed forward from the rear end of the holding member 300, so that the second contact press-fit portions 458 of each of the second contacts 450 bite into the holding member 300. Accordingly, each of the second contacts 450 is held by the holding member 300.

Figure 8:
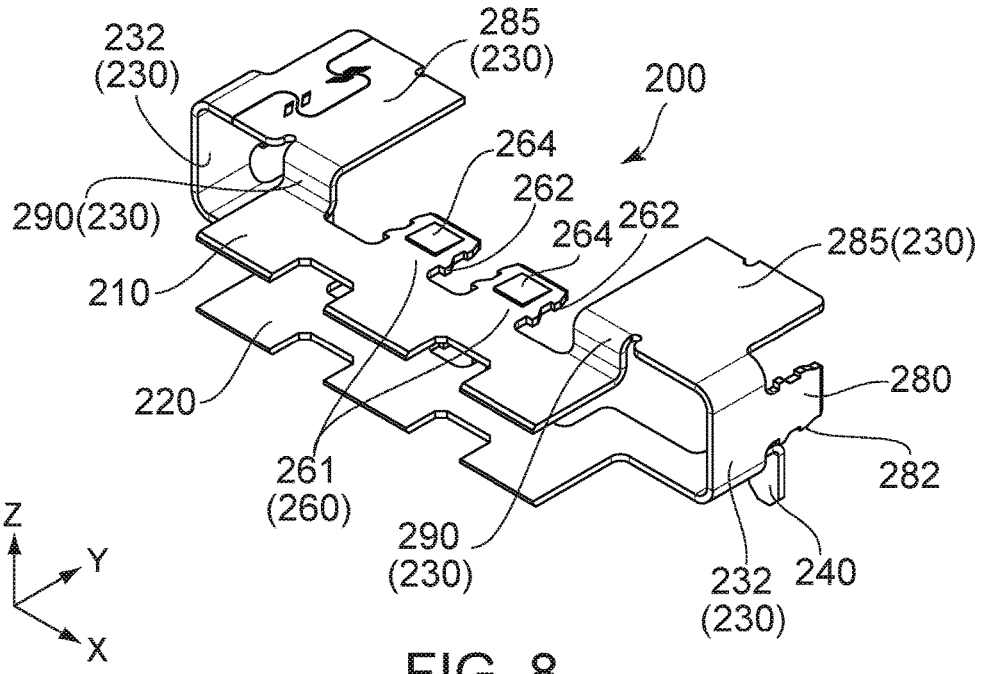
FIG. 8 is an upper perspective view showing a ground member included in the connector of FIG. 1.
Figure 9:
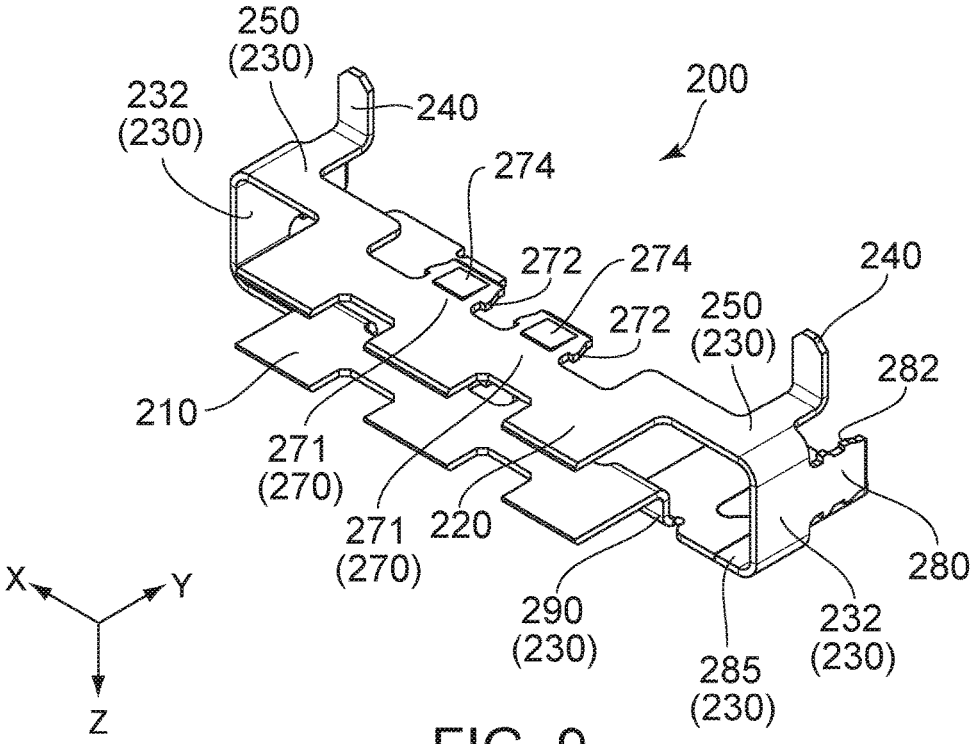
FIG. 9 is a lower perspective view showing the ground member of FIG. 8.
Figure 10:
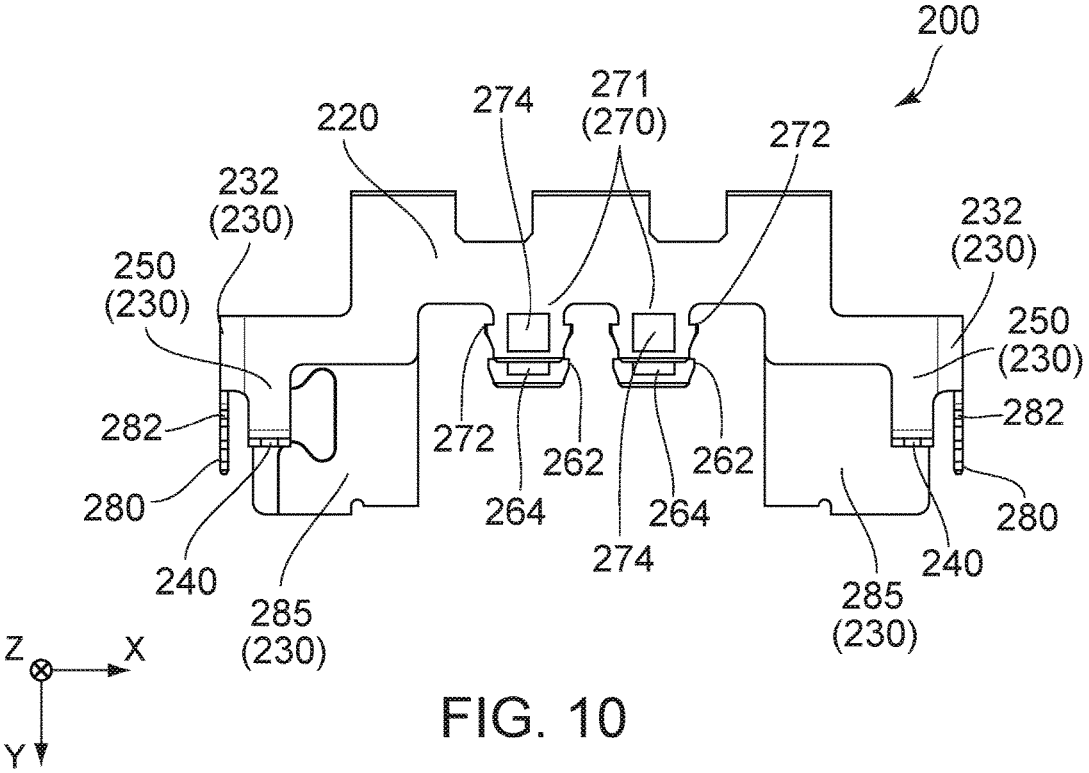
FIG. 10 is a bottom view showing the ground member of FIG. 8.

As shown in FIGS. 8 to 10, the ground member 200 is formed as a single component. Specifically, the ground member 200 has an upper plate portion 210, a lower plate portion 220, two coupling portions 230, two fixed legs 240, two upper press-fit portions 260, two lower press-fit portions 270 and two auxiliary press-fit portions 280.

As understood from FIGS. 1. 2 and 8 to 10, the upper plate portion 210 extends in a predetermined plane intersecting with the up-down direction. More specifically, the upper plate portion 210 extends in a plane perpendicular to the up-down direction. The upper plate portion 210 is coupled with the coupling portions 230 at its rear ends which are positioned in the vicinities of its opposite ends, respectively, in the pitch direction. The lower plate portion 220 extends in the predetermined plane intersecting with the up-down direction. More specifically, the lower plate portion 220 extends in the plane perpendicular to the up-down direction. The lower plate portion 220 is coupled with the coupling portions 230 at its rear ends which are positioned in the vicinities of its opposite ends, respectively, in the pitch direction. In other words, the upper plate portion 210 and the lower plate portion 220 are coupled with each other by the coupling portions 230. The upper plate portion 210 and the lower plate portion 220 are arranged so as to be apart from each other in the up-down direction. The holding portion 310 is sandwiched by the upper plate portion 210 and the lower plate portion 220 in the up-down direction. The fitting portion 320 is positioned forward in the front-rear direction beyond any of the upper plate portion 210 and the lower plate portion 220.

As understood from FIGS. 1, 2, 5 and 8 to 10, each of the coupling portions 230 has a coupling vertical portion 232, an outer portion 285, a connecting portion 290 and an extending portion 250. In other words, the extending portion 250 is a part of the coupling portion 230. The coupling vertical portions 232 extend upward in the up-down direction from the rear ends of the lower plate portion 220 which are positioned at its opposite ends, respectively, in the pitch direction. The outer portion 285 is coupled with an upper end of the coupling vertical portion 232. The outer portion 285 extends in the plane perpendicular to the up-down direction. The connecting portion 290 extends downward from a front end of the outer portion 285 which is positioned at its inner end in the pitch direction. The connecting portions 290 are connected with the rear ends of the upper plate portion 210 which are positioned at its opposite ends, respectively, in the pitch direction. In other words, each of the coupling portions 230 couples the rear end of the upper plate portion 210 and the rear end of the lower plate portion 220 with each other. The extending portion 250 extends rearward from the lower plate portion 220. Specifically, the extending portions 250 extend rearward from the rear ends of the lower plate portion 220 which are positioned at its opposite ends, respectively, in the pitch direction. Each of the extending portions 250 extends from the lower plate portion 220 in the predetermined plane intersecting with the up-down direction. More specifically, each of the extending portions 250 extends from the lower plate portion 220 in an XY-plane, namely, in the plane perpendicular to the up-down direction. Furthermore specifically, each of the extending portions 250 extends in the Y-direction from the lower plate portion 220 while extending toward the coupling vertical portion 232. As shown in FIGS. 2 and 9, the extending portion 250 connects the fixed leg 240 and the lower plate portion 220 with each other.

As shown in FIGS. 1 to 5, each of the coupling portions 230 of the present embodiment is positioned inward of an outer circumference of the holding member 300 in a direction perpendicular to the front-rear direction. More specifically, each of the coupling portions 230 of the present embodiment is positioned inward of an outer circumference of the supporting portion 370 of the holding member 300 in the direction perpendicular to the front-rear direction. Accordingly, the ground member 200 has a low probability to be unintentionally brought into contact with a member other than members included in the connector 100.

Figure 12:
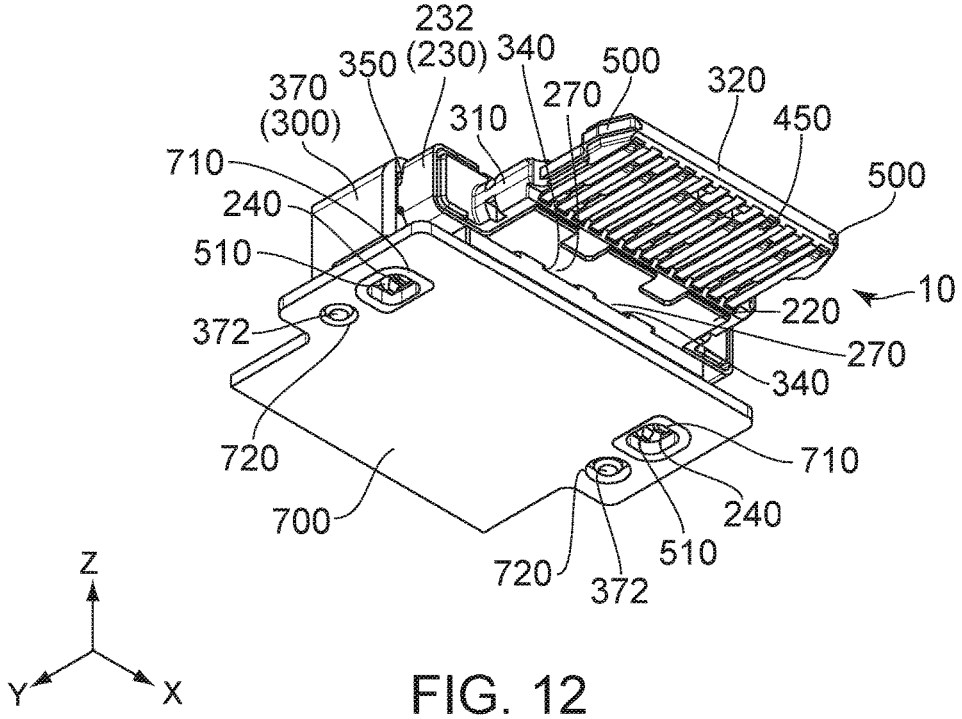
FIG. 12 is a perspective view showing a connector assembly in which the connector of FIG. 1 is mounted on a circuit board. In the figure, a fixed leg of the ground member and a leg portion of a midplate are fixed to a single through hole.

As shown in FIGS. 2 and 12, each of the fixed legs 240 is configured to be fixed to the circuit board 700. The fixed legs 240 of the present embodiment extend downward in the up-down direction from the extending portions 250, respectively. The fixed legs 240 are positioned in the vicinities of opposite ends, respectively, of the connector 100 in the pitch direction.

As shown in FIG. 8, each of the upper press-fit portions 260 has an upper main portion 261 having a plate-like shape, upper engaging protrusions 262 and an upper bulge 264. Each of the upper press-fit portions 260 extends rearward in the front-rear direction from the upper plate portion 210. More specifically, the upper main portion 261 of the upper press-fit portion 260 extends rearward from a rear end of the upper plate portion 210 in the front-rear direction. Each of the upper engaging protrusions 262 protrudes in the pitch direction from the upper main portion 261. More specifically, the upper engaging protrusions 262 are positioned at opposite ends of the upper main portion 261 in the pitch direction and each protrudes outward in the pitch direction. The upper bulge 264 is bulged upward in the up-down direction from the upper main portion 261.

As shown in FIG. 9, each of the lower press-fit portions 270 has a lower main portion 271 having a plate-like shape, lower engaging protrusions 272 and a lower bulge 274. Each of the lower press-fit portions 270 extends rearward in the front-rear direction from the lower plate portion 220. More specifically, the lower main portion 271 of the lower press-fit portion 270 extends rearward from a rear end of the lower plate portion 220 in the front-rear direction. Each of the lower engaging protrusions 272 protrudes in the pitch direction from the lower main portion 271. More specifically, the lower engaging protrusions 272 are positioned at opposite ends of the lower main portion 271 in the pitch direction and each protrudes outward in the pitch direction. The lower bulge 274 is bulged downward in the up-down direction from the lower main portion 271. Each of the upper press-fit portions 260 is positioned above any of the lower press-fit portions 270 in the up-down direction The auxiliary press-fit portions 280 extend rearward in the front-rear direction from the coupling portions 230, respectively. More specifically, each of the auxiliary press-fit portions 280 extends rearward in the front-rear direction from a rear end of the coupling vertical portion 232 of the coupling portion 230 corresponding thereto. Each of the auxiliary press-fit portions 280 is provided with auxiliary engaging protrusions 282 each of which protrudes in a direction perpendicular to the front-rear direction. More specifically, the auxiliary engaging protrusions 282 are positioned at opposite ends of the auxiliary press-fit portion 280 in the up-down direction and each protrudes outward in the up-down direction.

Referring to FIGS. 1 to 4 and 11, the ground member 200 is attached to the holding member 300 by being press-fit into the holding member 300. Specifically, the ground member 200 is inserted rearward from a front of the holding member 300, and the upper press-fit portions 260, the lower press-fit portions 270 and the auxiliary press-fit portions 280 of the ground member 200 are pushed into the upper press-fit ditches 330, the lower press-fit ditches 340 and the auxiliary press-fit ditches 350, respectively, of the holding member 300. Accordingly, the upper engaging protrusions 262 of each of the upper press-fit portions 260 bite into the upper press-fit ditch 330 corresponding thereto. Similarly, the lower engaging protrusions 272 of each of the lower press-fit portions 270 bite into the lower press-fit ditch 340 corresponding thereto and the auxiliary engaging protrusions 282 of each of the auxiliary press-fit portions 280 bite into the auxiliary press-fit ditch 350 corresponding thereto. Thus, the ground member 200 is held by the holding member 300.

In detail, as understood from FIGS. 1, 2 and 11, the two upper press-fit portions 260 correspond the two upper press-fit ditches 330, respectively, and each of the upper press-fit portions 260 is received in the upper press-fit ditch 330 corresponding thereto. In addition, the two lower press-fit portions 270 correspond to the two lower press-fit ditches 340, respectively, and each of the lower press-fit portions 270 is received in the lower press-fit ditch 340 corresponding thereto. Furthermore, the two auxiliary press-fit portions 280 correspond to the two auxiliary press-fit ditches 350, respectively, and each of the auxiliary press-fit portions 280 is received in the auxiliary press-fit ditch 350 corresponding thereto.

Meanwhile, the upper engaging protrusions 262 bite into the inner walls of the upper press-fit ditch 330 which face each other in the pitch direction, and the upper bulge 264 is brought into pressing contact with the inner wall of the upper press-fit ditch 330 which is positioned at an upper side of the upper press-fit ditch 330. Accordingly, the upper main portion 261 is pressed to the inner wall of the upper press-fit ditch 330 which is positioned at a lower side of the upper press-fit ditch 330, while the upper plate portion 210 is pressed to an upper surface of the holding portion 310. Also meanwhile, the lower engaging protrusions 272 bite into the inner walls of the lower press-fit ditch 340 which face each other in the pitch direction, and the lower bulge 274 is brought into pressing contact with the inner wall of the lower press-fit ditch 340 which is positioned at a lower side of the lower press-fit ditch 340. Accordingly, the lower main portion 271 is pressed to the inner wall of the lower press-fit ditch 340 which is positioned at an upper side of the lower press-fit ditch 340, while the lower plate portion 220 is pressed to a lower surface of the holding portion 310. Thus, even if the connector 100 is repeatedly inserted into and removed from the mating connector (not shown), the ground member 200 can be prevented from being lifted from the holding member 300 and from being removed from the holding member 300 by being pulled forward.

In addition, meanwhile, the auxiliary engaging protrusions 282 bite into the inner walls of the auxiliary press-fit ditch 350 which face each other in the up-down direction. Accordingly, each of the auxiliary press-fit portions 280 is rigidly held by the auxiliary press-fit ditch 350 corresponding thereto, so that the ground member 200 is further rigidly attached to the holding member 300.

Since the ground member 200 is formed as the single component as described above, the ground member 200 can be attached to the holding member 300 in a simplified process as compared with a ground member formed as multiple members. In addition, as described above, the ground member 200 is attached to the holding member 300 by being press-fit into the holding member 300 from its front. Accordingly, as compared with a ground member attached to a holding member along an up-down direction, lift and removal of the ground member 200 from the holding member 300 are prevented when the mating connector (not shown) is mated with and removed from the connector 100.

Figure 3:
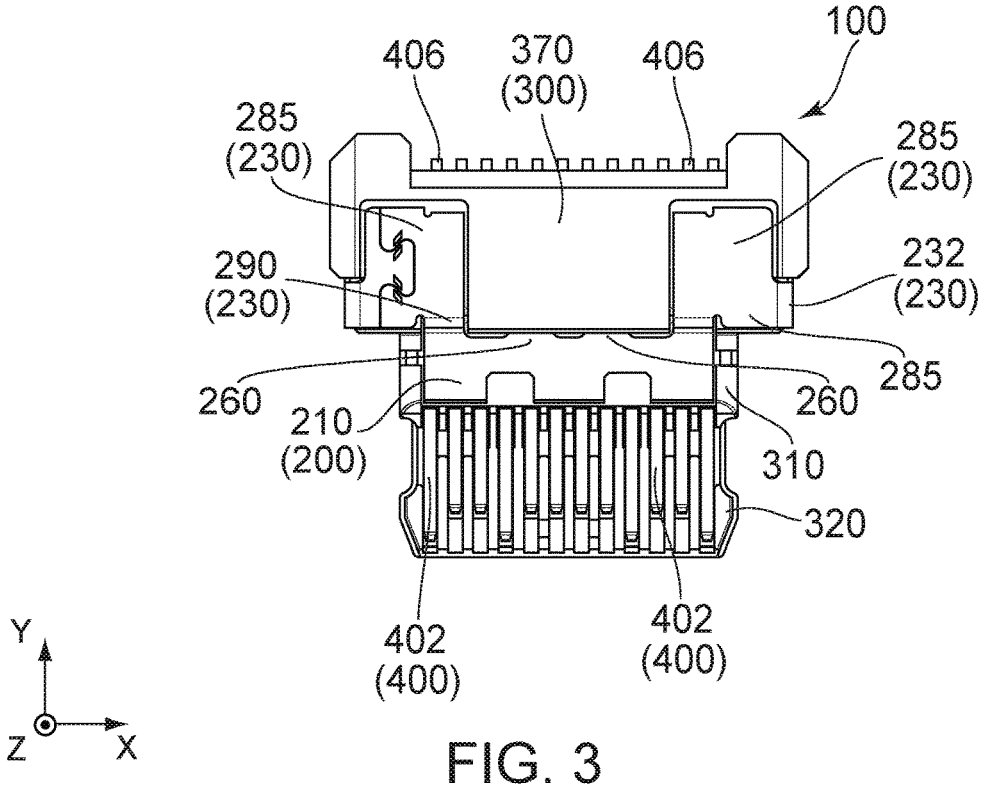
FIG. 3 is a top view showing the connector of FIG. 1.

As understood from FIGS. 1, 3 and 8, in the pitch direction, each of the upper press-fit portions 260 is arranged inward of the first contacts 400 which are arranged at opposite ends, respectively, of the first contact row in the pitch direction. More specifically, in the pitch direction, each of the upper press-fit portions 260 is arranged inward of the first held portions 404 of the first contacts 400 which are arranged at the opposite ends, respectively, of the first contact row in the pitch direction.

Figure 4:
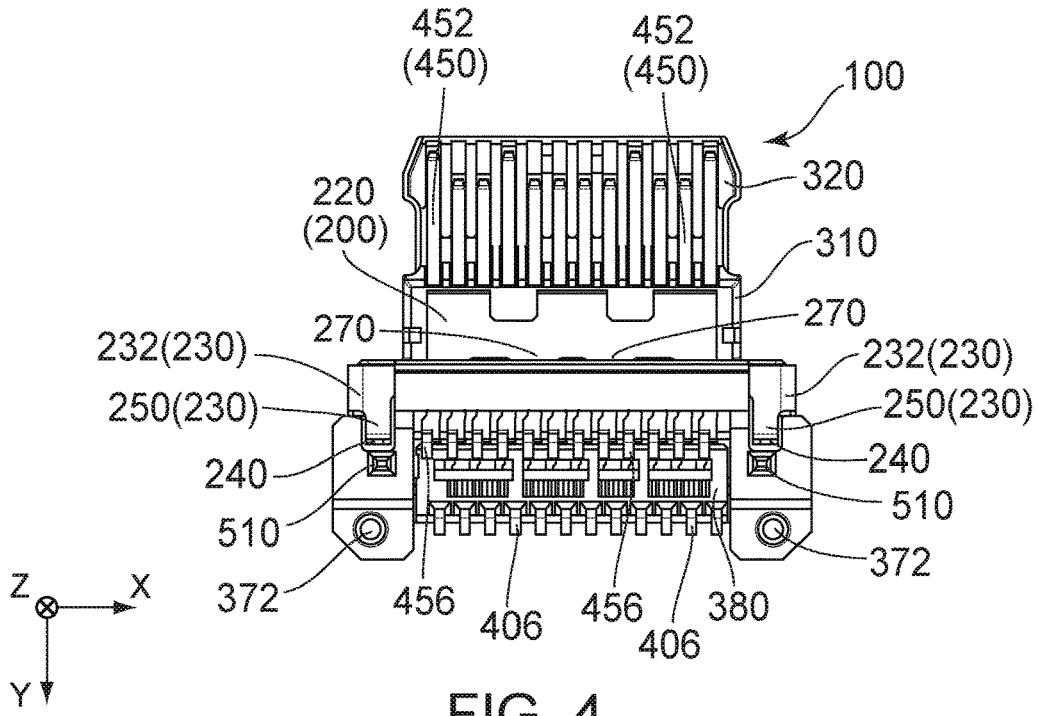
FIG. 4 is a bottom view showing the connector of FIG. 1.

As understood from FIGS. 2, 4 and 9, in the pitch direction, each of the lower press-fit portions 270 is arranged inward of the second contacts 450 which are arranged at opposite ends, respectively, of the second contact row in the pitch direction. More specifically, in the pitch direction, each of the lower press-fit portions 270 is arranged inward of the second held portions 454 of the second contacts 450 which are arranged at the opposite ends, respectively, of the second contact row in the pitch direction.

Figure 5:
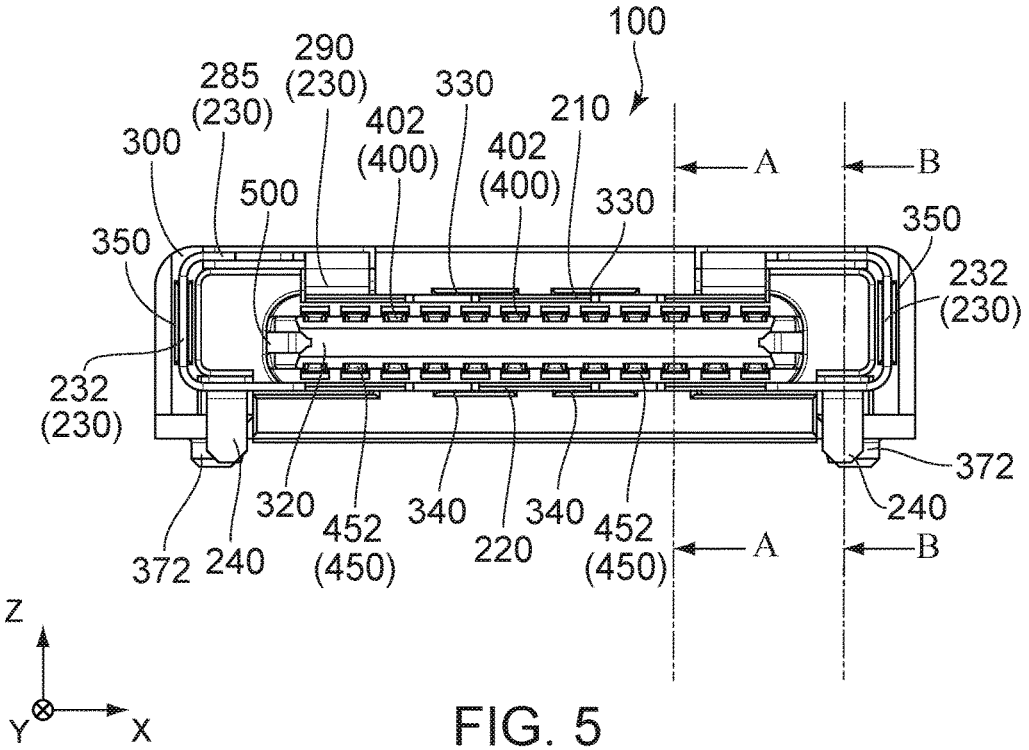
FIG. 5 is a front view showing the connector of FIG. 1.

As shown in FIGS. 2, 5 and 6, the midplate 500 is held by the holding member 300 so as to be positioned between the first contact row and the second contact row in the up-down direction. Specifically, the midplate 500 is embedded in the holding member 300 via insert-molding. The midplate 500 has two leg portions 510 each of which is configured to be connected to the circuit board 700. The leg portions 510 are positioned in the vicinities of the opposite ends, respectively, of the connector 100 in the pitch direction. The leg portions 510 are paired with the fixed legs 240, respectively, of the ground member 200. In other words, the fixed legs 240 and the leg portions 510 form two pairs.

As understood from FIGS. 2 and 12, a connector assembly 10 of an embodiment of the present invention comprises the connector 100 and the circuit board 700. The circuit board 700 is formed with two through holes 710 and two apertures 720. The leg portion 510 of the midplate 500 and the fixed leg 240 of the ground member 200, which are included in each pair of the two pairs, are altogether fixed to the single through hole 710 of the circuit board 700. Accordingly, the connector 100 has enhanced grounding. Since the leg portion 510 and the fixed leg 240, which are included in each pair of the two pairs, are simultaneously fixed to the circuit board 700, the connector assembly 10 can be assembled in a simplified process.

In the connector assembly 10 of the present embodiment, the first fixed portion 406 of each of the first contacts 400 and the second fixed portion 456 of each of the second contacts 450 are fixed on the circuit board 700 by soldering. In addition, the projecting portions 372 of the holding member 300 are inserted into the apertures 720, respectively, of the circuit board 700, so that the holding member 300 is fixed to the circuit board 700.

Figure 13:
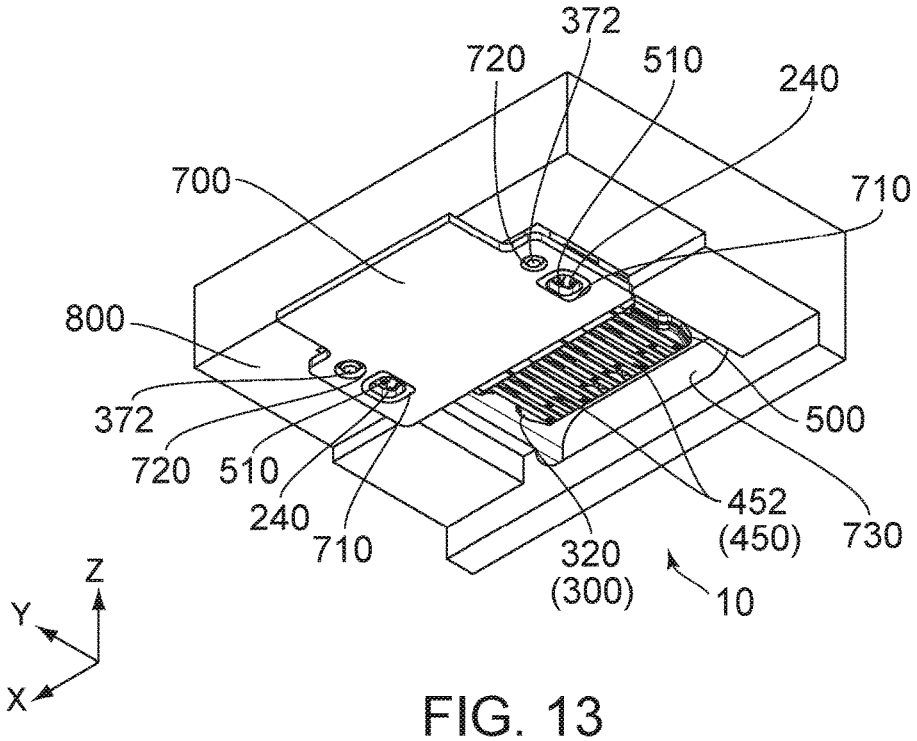
FIG. 13 is a perspective view showing a state where the connector assembly of FIG. 12 is fixed to a housing.
Figure 14:
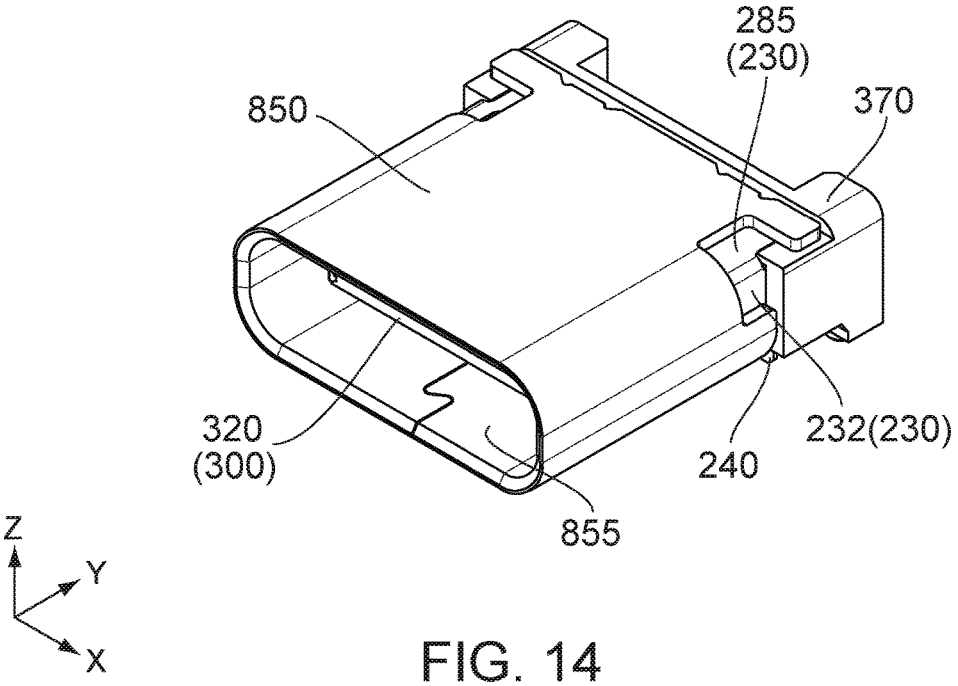
FIG. 14 is a perspective view showing a state where a shell is attached to the connector of FIG. 1.
Figure 15:
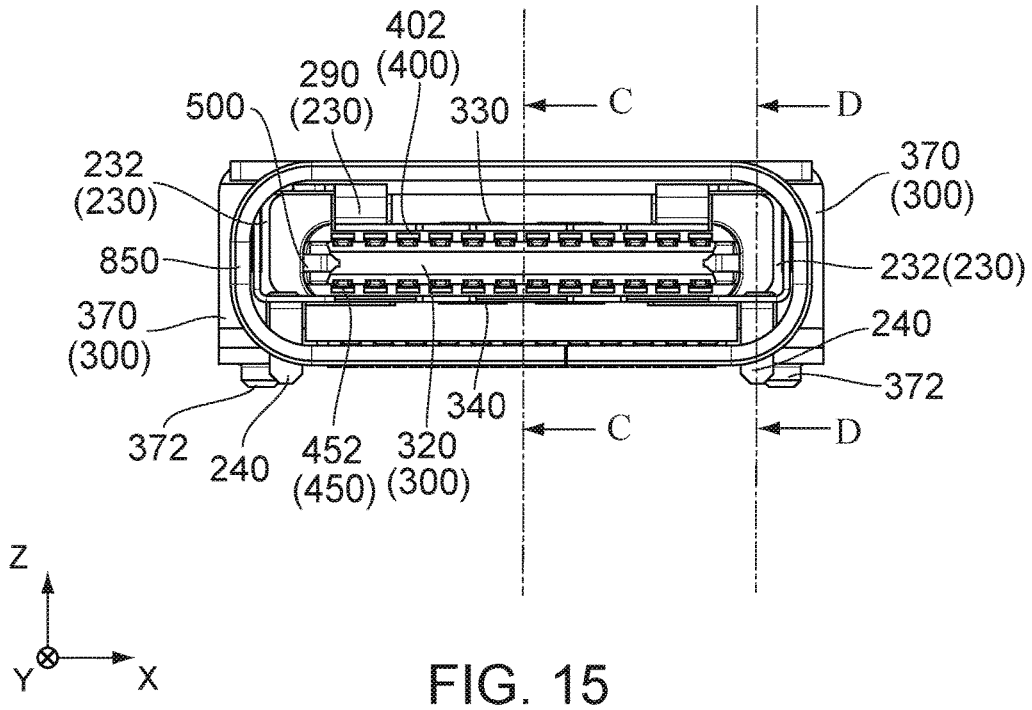
FIG. 15 is a front view showing the connector of FIG. 14.
Figure 16:
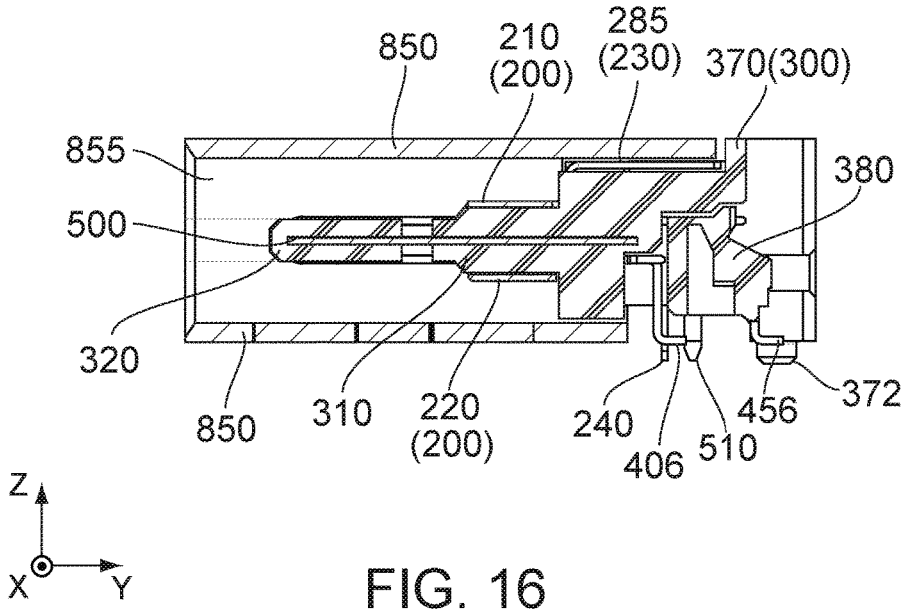
FIG. 16 is a cross-sectional view showing the connector of FIG. 15, taken along line C-C.
Figure 17:
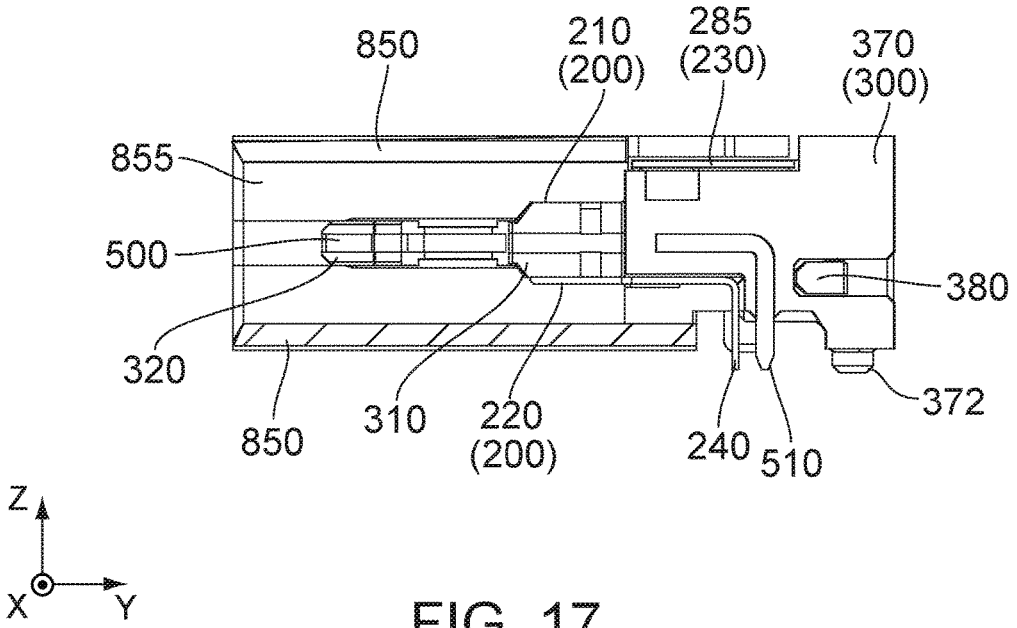
FIG. 17 is a cross-sectional view showing the connector of FIG. 15, taken along line D-D.

As shown in FIG. 13, the connector assembly 10 is attached to a housing 800. The housing 800 has an opening 730. The connector 100 is mateable with the mating connector (not shown) through the opening 730.

While the present invention has been described with specific embodiments, the present invention is not limited to the aforementioned embodiments.

Although the connector 100 of the aforementioned embodiment has no shell, the connector 100 may further comprise, as shown in FIGS. 14 to 17, a shell 850 which has a shell opening 855 and which covers the fitting portion 320 in a plane perpendicular to the front-rear direction. Also, in the connector 100 comprising the shell 850, the fixed legs 240 of the ground member 200 and the leg portions 510 of the midplate 500 are directly connected to the circuit board 700. Accordingly, similar to the connector 100 of the present embodiment, the connector 100 comprising the shell 850 can be prevented from having variations in electrical characteristic even if the connector 100 has variations in quality resulting from a connecting process of its assembly.

Figure 18:
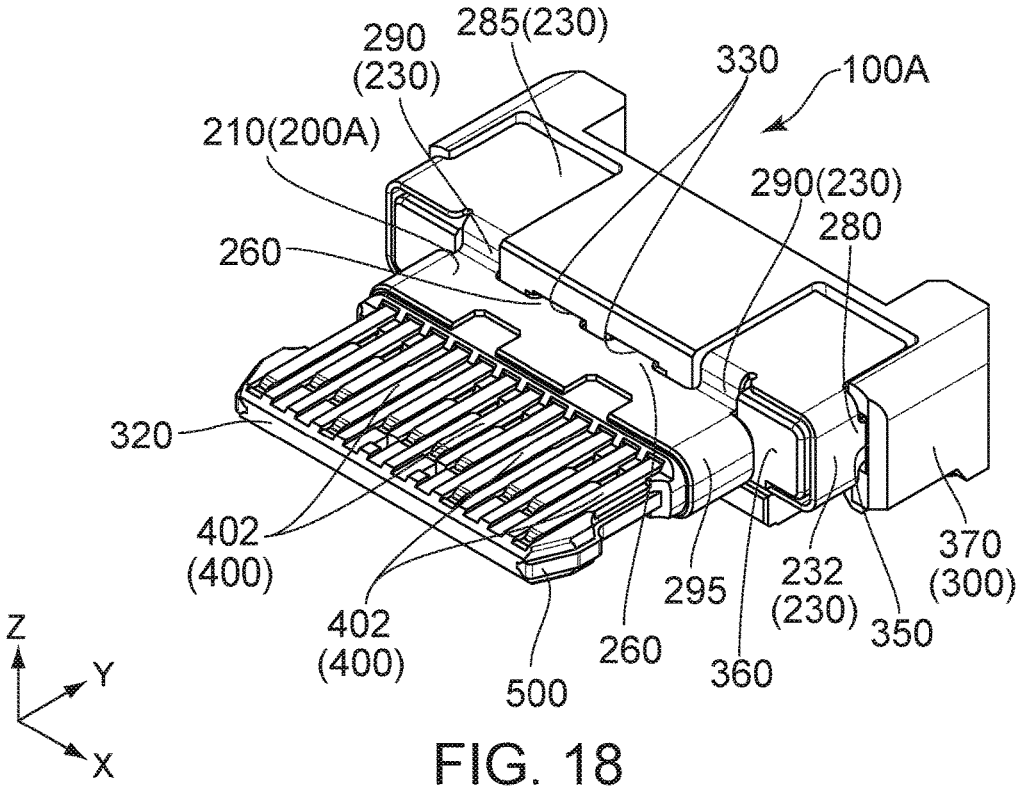
FIG. 18 is an upper perspective view showing a modification of the connector of FIG. 1.
Figure 19:
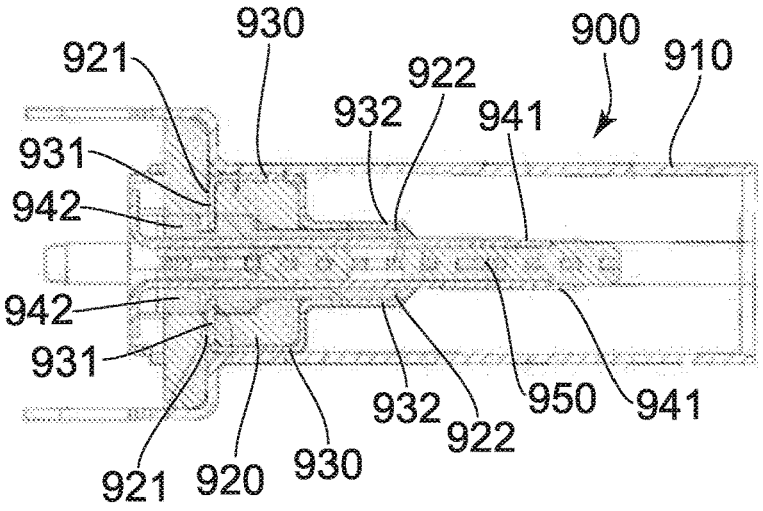
FIG. 19 PRIOR ART
FIG. 19 is a cross-sectional view showing a connector socket of Patent Document 1.
Figure 20:
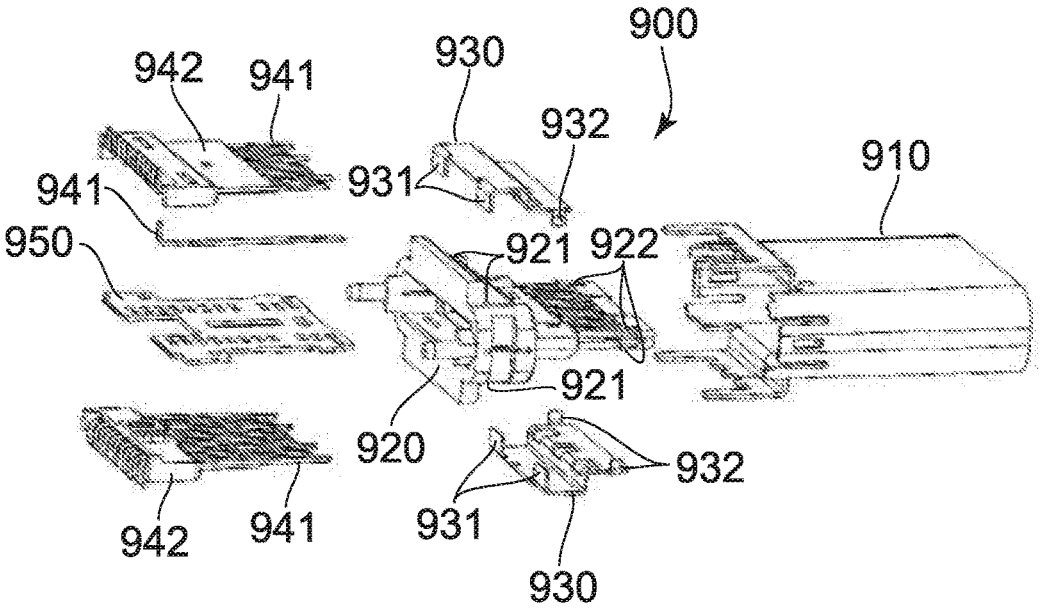
FIG. 20 PRIOR ART
FIG. 20 is an exploded, perspective view showing the connector socket of Patent Document 1.

The ground member 200 of the connector 100 of the aforementioned embodiment has a structure in which the opposite ends of the upper plate portion 210 in the pitch direction and the opposite ends of the lower plate portion 220 in the pitch direction are not coupled with each other. As shown in FIG. 18, a connector 100A according to a modification comprises a ground member 200A, which is attached to the holding member 300, instead of the ground member 200 of the aforementioned embodiment. Specifically, the ground member 200A has a structure in which opposite ends of an upper plate portion 210 in the pitch direction and opposite ends of a lower plate portion 220 in the pitch direction are coupled with each other by plate portion coupling portions 295, respectively. Since the ground member 200A has the structure same as that of the ground member 200 except for having the plate portion coupling portions 295, a component of the ground member 200A, which has the same structure as the component of the ground member 200, is referred to by using the same sign in the figure.

In the connector 100A of the modification having the ground member 200A, the upper plate portion 210 and the lower plate portion 220 are rigidly coupled with each other. Accordingly, when the connector 100A is inserted into and removed from a mating connector (not shown), the ground member 200A can be more securely prevented from being lifted from the holding member 300.

The present application is based on a Japanese patent application of JP2015-219671 filed before the Japan Patent Office on Nov. 9, 2015, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

| Reference Signs List | |
|---|---|
| 10 | connector assembly |
| 100, 100A | connector |
| 200, 200A | ground member |
| 210 | upper plate portion |
| 220 | lower plate portion |
| 230 | coupling portion |
| 232 | coupling vertical portion |
| 240 | fixed leg |
| 250 | extending portion |
| 260 | upper press-fit portion |
| 261 | upper main portion |
| 262 | upper engaging protrusion |
| 264 | upper bulge |
| 270 | lower press-fit portion |
| 271 | lower main portion |
| 272 | lower engaging protrusion |
| 274 | lower bulge |
| 280 | auxiliary press-fit portion |
| 282 | auxiliary engaging protrusion |
| 285 | outer portion |
| 290 | connecting portion |
| 295 | plate portion coupling portion |
| 300 | holding member |
| 310 | holding portion |
| 320 | fitting portion |
| 322 | contact holding ditch |
| 330 | upper press-fit ditch |
| 340 | lower press-fit ditch |
| 350 | auxiliary press-fit ditch |
| 360 | middle portion |
| 370 | supporting portion |
| 372 | projecting portion |
| 374 | outer portion accommodating portion |
| 380 | auxiliary holding member |
| 400 | first contact (contact) |
| 402 | first contact portion (contact portion) |
| 404 | first held portion (held portion) |
| 406 | first fixed portion |
| 408 | first contact press-fit portion |
| 450 | second contact (contact) |
| 452 | second contact portion (contact portion) |
| 454 | second held portion (held portion) |
| 456 | second fixed portion |
| 458 | second contact press-fit portion |
| 500 | midplate |
| 510 | leg portion |
| 700 | circuit board |
| 710 | through hole |
| 720 | aperture |
| 730 | opening |
| 800 | housing |
| 850 | shell |
| 855 | shell opening |

The invention claimed is:

1. A connector mountable on a circuit board and mateable with a mating connector along a front-rear direction, wherein:

the mating connector comprises a plurality of mating contacts;

the connector comprises a ground member, a holding member, a plurality of contacts and a midplate;

the ground member has an upper plate portion, a lower plate portion, a coupling portion, a fixed leg and an extending portion;

the upper plate portion and the lower plate portion are arranged so as to be apart from each other in an up-down direction perpendicular to the front-rear direction;

each of the upper plate portion and the lower plate portion extends in a predetermined plane intersecting with the up-down direction;

the coupling portion couples the upper plate portion and the lower plate portion with each other;

the fixed leg is configured to be fixed to the circuit board;

the fixed leg extends downward in the up-down direction from the extending portion;

the extending portion connects the fixed leg and the lower plate portion with each other;

the extending portion extends in the predetermined plane from the lower plate portion;

the holding member has a holding portion and a fitting portion;

the holding portion is sandwiched by the upper plate portion and the lower plate portion in the up-down direction;

the fitting portion extends forward in the front-rear direction from the holding portion;

the fitting portion is positioned forward in the front-rear direction beyond any of the upper plate portion and the lower plate portion;

the fitting portion has an upper surface and a lower surface each facing in the up-down direction;

the plurality of contacts are arranged in two contact rows;

the contacts of each of the contact rows are arranged in a pitch direction perpendicular to the front-rear direction and the up-down direction;

each of the contacts has a held portion and a contact portion;

the held portion is held by the holding portion;

the contact portions are configured to be brought into contact with the mating contacts, respectively, of the mating connector when the connector is mated with the mating connector;

the contact portion is exposed outside the fitting portion on the upper surface or the lower surface of the fitting portion; and the midplate is held by the holding member so as to be positioned between the contact rows in the up-down direction.

2. The connector as recited in claim 1, wherein the extending portion extends rearward in the front-rear direction from the lower plate portion.

3. The connector as recited in claim 1, wherein:

the upper plate portion has a rear end in the front-rear direction;

the lower plate portion has a rear end in the front-rear direction; and the coupling portion couples the rear end of the upper plate portion and the rear end of the lower plate portion with each other.

4. The connector as recited in claim 3, wherein the extending portion is a part of the coupling portion.

5. The connector as recited in claim 1, wherein:

the ground member further has an upper press-fit portion and a lower press-fit portion;

the upper press-fit portion extends rearward in the front-rear direction from the upper plate portion;

the lower press-fit portion extends rearward in the front-rear direction from the lower plate portion;

the holding member is formed with an upper press-fit ditch and a lower press-fit ditch;

the upper press-fit portion is received in the upper press-fit ditch; and the lower press-fit portion is received in the lower press-fit ditch.

6. The connector as recited in claim 5, wherein:

the upper press-fit portion has an upper main portion, an upper engaging protrusion and an upper bulge;

the upper main portion has a plate-like shape and extends rearward in the front-rear direction from the upper plate portion;

the upper engaging protrusion protrudes in the pitch direction from the upper main portion;

the upper bulge is bulged upward in the up-down direction from the upper main portion;

the lower press-fit portion has a lower main portion, a lower engaging protrusion and a lower bulge;

the lower main portion has a plate-like shape and extends rearward in the front-rear direction from the lower plate portion;

the lower engaging protrusion protrudes in the pitch direction from the lower main portion; and the lower bulge is bulged downward in the up-down direction from the lower main portion.

7. The connector as recited in claim 5, wherein:

the two contact rows include a first contact row and a second contact row;

the first contact row is positioned above the second contact row in the up-down direction;

the upper press-fit portion is positioned above the lower press-fit portion in the up-down direction;

in the pitch direction, the upper press-fit portion is arranged inward of the contacts which are arranged at opposite ends, respectively, of the first contact row in the pitch direction; and in the pitch direction, the lower press-fit portion is arranged inward of the contacts which are arranged at opposite ends, respectively, of the second contact row in the pitch direction.

8. The connector as recited in claim 1, wherein:

the ground member further has an auxiliary press-fit portion;

the auxiliary press-fit portion extends rearward in the front-rear direction from the coupling portion;

the auxiliary press-fit portion is provided with a auxiliary engaging protrusion which protrudes in a direction perpendicular to the front-rear direction;

the holding member is formed with an auxiliary press-fit ditch; and the auxiliary press-fit portion is received in the auxiliary press-fit ditch.

9. The connector as recited in claim 1, wherein the ground member is formed as a single component.

10. The connector as recited in claim 1, wherein:

the holding member has an outer circumference; and the coupling portion of the ground member is positioned inward of the outer circumference of the holding member in a direction perpendicular to the front-rear direction.

11. A connector assembly comprising the connector as recited in claim 1 and the circuit board, wherein:

the circuit board is formed with a single through hole;

the midplate has a leg portion; and the leg portion and the fixed leg are fixed to the single through hole.

* * * * *